United States Patent [19]

Yukl

[11] Patent Number: 4,949,094

[45] Date of Patent: Aug. 14, 1990

[54] NEARFIELD/FARFIELD ANTENNA WITH PARASITIC ARRAY

[75] Inventor: Tex Yukl, Baker, Oreg.

[73] Assignee: Spatial Dynamics, Ltd., Baker, Oreg.

[21] Appl. No.: 694,084

[22] Filed: Jan. 23, 1985

[51] Int. Cl.[5] ..... H01Q 19/00; H01Q 13/02

[52] U.S. Cl. ..... 343/785; 343/833; 343/834; 343/908

[58] Field of Search ..... 343/785, 789, 741, 742, 343/878, 833, 834, 895

[56] References Cited

U.S. PATENT DOCUMENTS

| | | | |
|---|---|---|---|
| Re. 23,051 | 11/1948 | Carter | 343/786 |
| 2,232,179 | 2/1941 | King | 343/786 |
| 2,588,610 | 3/1952 | Boothroyd et al. | 343/785 |
| 2,663,797 | 12/1953 | Kock | 343/785 |
| 2,927,322 | 3/1960 | Simon et al. | 343/785 |
| 2,955,287 | 10/1960 | Bogner | 343/753 |
| 3,128,467 | 4/1964 | Lanctot | 343/785 |
| 3,491,361 | 1/1970 | Campbell | 343/833 |
| 3,936,835 | 2/1976 | Phelan | 343/753 |
| 4,290,068 | 9/1981 | Bogner | 343/702 |
| 4,295,141 | 10/1981 | Bogner | 343/753 |
| 4,356,493 | 10/1982 | Bogner | 343/702 |
| 4,427,984 | 1/1984 | Anderson | 343/895 |

FOREIGN PATENT DOCUMENTS

| | | | |
|---|---|---|---|
| 2648375 | 4/1978 | Fed. Rep. of Germany | 343/785 |

*Primary Examiner*—Michael C. Wimer

*Attorney, Agent, or Firm*—Kolisch, Hartwell & Dickinson

[57] ABSTRACT

A parasitic array for use on a transmission/reception antenna which comprises a cylindrical dielectric support having plural conductive, ring-like parasitic elements spaced along the support. The support is an elongate, hollow structure with closed ends and the parasitic elements are formed of a conductive film applied to the outer surface of the support.

7 Claims, 2 Drawing Sheets

NEARFIELD/FARFIELD ANTENNA WITH PARASITIC ARRAY

BACKGROUND AND SUMMARY OF THE INVENTION

This invention pertains to a parasitic array for use on a farfield/nearfield transmission/reception antenna. Specifically, the parasitic array of the instant invention is a strong, durable and easily manufactured device which significantly increases the gain of an antenna.

Parasitic arrays are well known in the antenna art. Generally, an array includes a series of conductive disks or dipoles which are secured to a non-conductive support. The support and parasitic elements are mounted on the antenna to increase the gain of the antenna. To be effective, the array must be aligned on the transmission/reception axis of the antenna. Known array supports are generally flexible and, under the influence of environmental forces, may flex, thereby becoming misaligned with the transmission/reception axis.

A general object of the present invention is to provide a parasitic array for use on an antenna which will significantly increase the overall gain of the antenna.

Another object of the invention is to provide a parasitic array which will remain centered on a transmission/reception axis of an antenna.

A further object of the invention is to provide a parasitic array having integral strength and long durability.

Another object of the instant invention is to provide a relatively low-cost parasitic array which is easy to manufacture.

The array of the invention is primarily intended for use on a farfield/nearfield transmission/reception antenna described in my copending application, Ser. No. 524,533, U.S. Pat. No. 4,878,059.

The parasitic array of the invention includes an elongate dielectric support which carries, about its outer surface, plural conductive, ring-like parasitic elements spaced at predetermined distances along the length of the support. Means are also provided for mounting the array on the antenna.

These and other objects and advantages of the instant invention will become more fully apparent as the description which follows is read in conjunction with the drawings.

DETAILED DESCRIPTION OF THE PREFERRED EMBODIMENT

1. Definitions and Design Formula

Set forth below are definitions (mathematical and verbal) presenting, in general terms, the design parameters necessary for any chosen operating frequency which are necessary to properly construct a parasitic element in accordance with the present invention. The parameters will be more fully discussed in the text which follows below.

K=K factor=0.9561 (for antenna body)

$f_o$=chosen operating frequency $f_d$=design operating frequency=

$$\frac{f_o}{K}$$

$$\lambda_a = \frac{V_a}{f_d}$$

where:

$\lambda_a$=wavelength in air, and $V_a$=propagation velocity in air $$\lambda_1 = \frac{V_1}{f_d}$$

where:

$\lambda_1$=wavelength in the antenna body material, and $V_1$=propagation velocity in the same material $$Z_o = 138\left[\log\frac{D_o}{D_i}\right]\left[\frac{V_1}{V_a}\right]$$

=coupled coaxial output impedance where:

$D_o$=inside diameter of outer conductor ring in coupling port $D_i$=outside diameter of inner conductor in coupling port $$A_1 = \frac{\lambda_a}{2}$$

$$A_2 = 0.1\,\lambda_1 + \frac{\lambda_a}{2}$$

$$A_3 = \frac{D_o}{2}$$

$$\text{Gain} = 10\log\left[\frac{\text{input aperture area} \times K_1}{\text{output aperture area} \times K_a}\right]$$

where:

$K_1$=dielectric constant of the antenna body material, and $K_a$=dielectric constant of air $R_{ic}$, $R_{oc}$, $R_{it}$, $R_{ot}$, $R_{itr}$ and $R_{otr}$ are different radial distances from the symmetry axis of the antenna $R_{ic}=A_1\cos\theta_1$ (inside radius of converter portion)

$R_{oc}=A_2\sec\theta_1$ (outside radius of converter portion)

$R_{it}=A_1\cos\theta_2$ (inside radius of terminator portion)

$R_{ot}=A_2\cos\theta_2$ (outside radius of terminator portion)

$R_{itr}=A_1\cos\theta_2$ (inside radius of transformer portion)

$R_{otr}=A_3$ (outside radius of transformer portion)

2. The Preferred Embodiment

Figure 1:
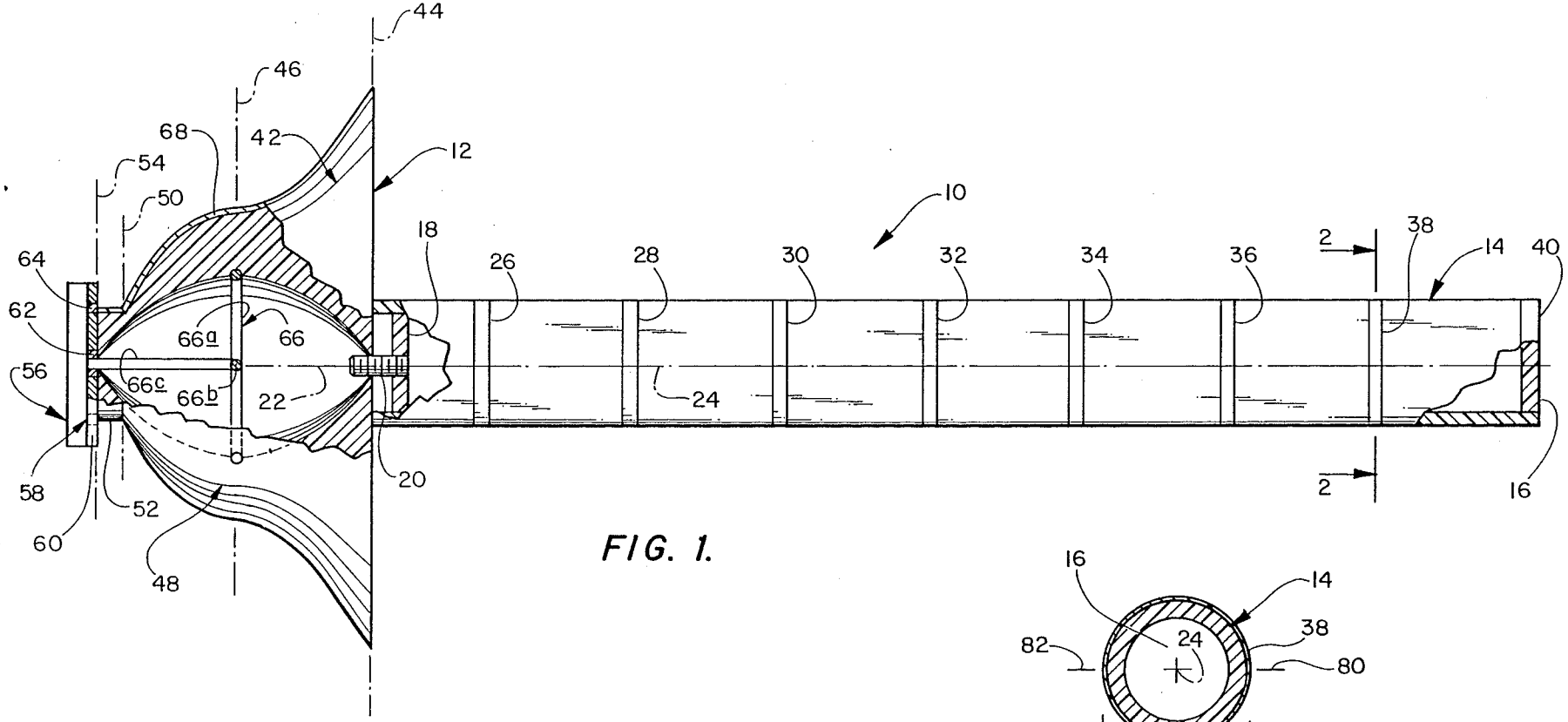
FIG. 1 is a side elevation of a parasitic array constructed in accordance with the present invention, shown attached to a nearfield/farfield transmission/-reception antenna, with certain portions broken away to illustrate details of construction.

Referring now to FIG. 1, a parasitic array constructed in accordance with the present invention is shown generally at 10. The array is mounted on a nearfield/farfield transmission/reception antenna 12.

The parasitic array includes an elongate dielectric support, shown generally at 14. Support 14 in the preferred embodiment is a poly-propylene tube which is hollow and cylindrical. The ends of the tube are closed by end plugs 16 and 18. End plug 18 is located adjacent one end of support 14 and has a threaded shaft 20 mounted in its center. Shaft 20 provides a means for mounting array 10 on antenna 12. End plug 16 is colocated with the other end of tube 14.

Antenna 12 has an axis of revolution 22 which is also referred to herein as the transmission/reception axis for the antenna. Array 10 has a central axis 24 which is at the center of support 14. When array 10 is properly mounted on antenna 12, transmission/reception axis 22 is coaxial with central axis 24. The two axes are maintained in their relative positions by shaft 20 which is threadably received in antenna 12.

Array 10 includes plural conductive film elements which are spaced along support 14. In the preferred embodiment, these elements are ring-like structures shown at 26, 28, 30, 32, 34, 36, 38 and 40. The eight conductive elements are zinc arch bands applied to dielectric support 14 by spray painting. Although the conductive elements may be applied to the support by any number of methods, the spray painting technique has proven to be most efficient and cost effective.

Returning now to the antenna which the parasitic array is intended for use with, the antenna includes three principal body portions, which are formed as a unitary structure. The first portion of the body includes a converter portion, shown generally at 42, which extends between a front plane of the antenna 44 and a central plane 46. A terminator portion, shown generally at 48, extends between central plane 46 and an intermediate plane 50. A coupling-impedance transformer portion 52 extends between intermediate plane 50 and rear plane 54. Antenna 12 is coupled to an external circuit, depicted generally at 56. A port 58 provides a connection between antenna 12 and circuit 56. Port 58 includes a plastic board 60 which carries an inner conductor ring 62 and an outer conductor ring 64 coaxial with ring 62 and operably connected to port 58. Circuit 56 may be carried on board 60, and both may be attached to the back face of the antenna, along rear plane 54.

A ring-like driven element, or expanse 66 is connected to ring 62 and disposed within antenna 12. Element 66 includes a ring portion **66*a* which is a nearly full circular component disposed in plane 46. Ring portion 66*a* joins with a radially inwardly extending arm portion 66*b*. The arm portion in turn joins with a finger portion 66*c* which is directly coupled to the inside of ring 62**.

The outer surface of antenna 12 is coated with a thin electrically conductive layer 68, shown greatly thickened, which, in the preferred embodiment, is the same zinc arch material as is used to form elements 26–40 on array 10.

Figure 2:
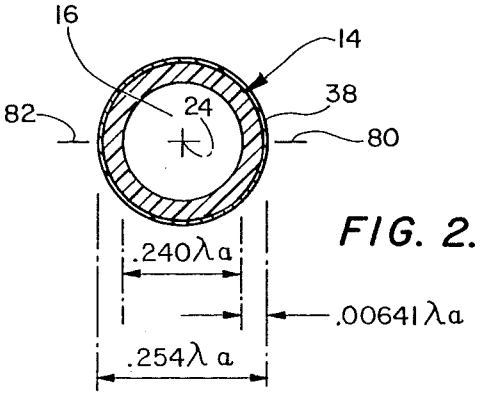
FIG. 2 is a cross section view of the array taken generally along the line 2—2 in FIG. 1.
Figure 3:
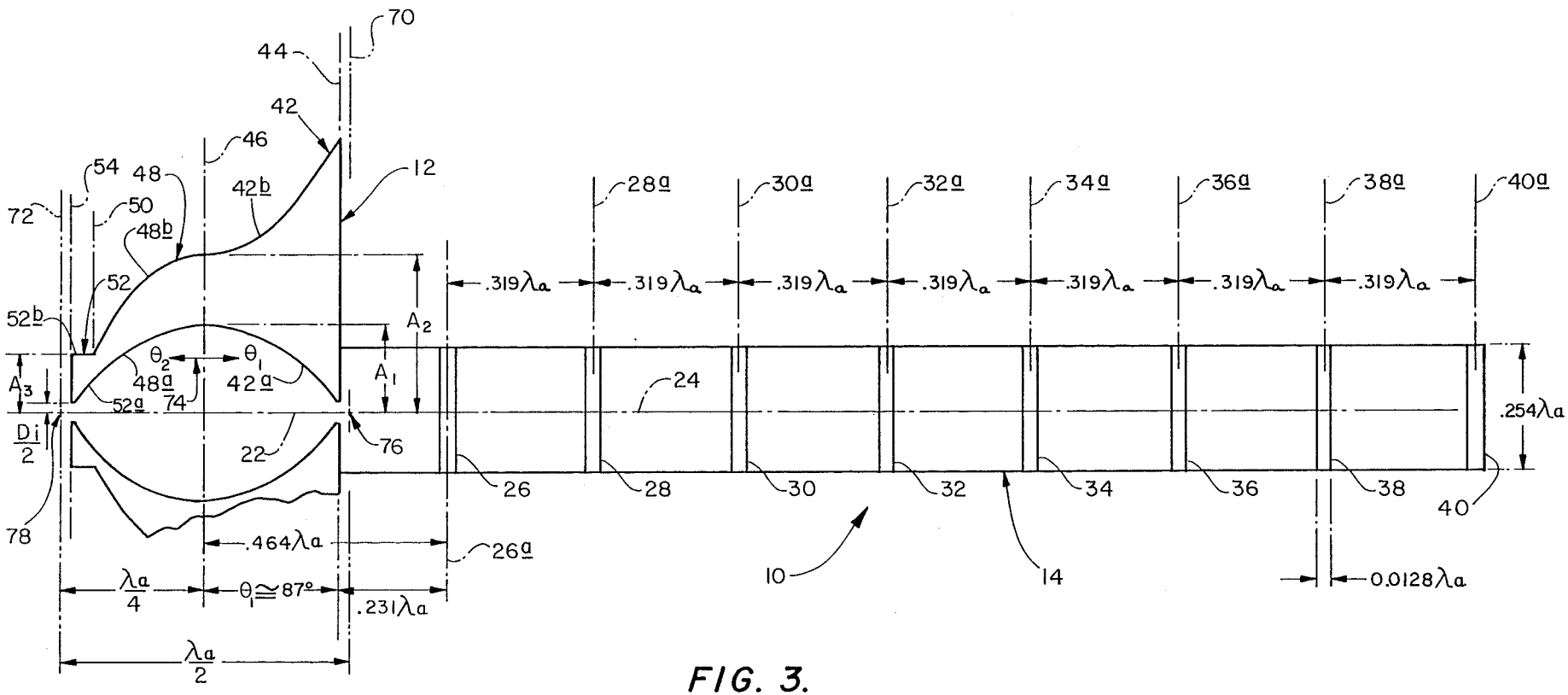
FIG. 3 is a schematic fragmentary view of the parasitic array and antenna of FIG. 1, marked to indicated important dimensions and design parameters.

Referring now to FIGS. 2 and 3, important dimensional features of the parasitic array and antenna are shown. Reference must also be made to the list of definitions and formulae earlier provided. The antenna shown is intended to operate at a frequency of 2525 megahertz, which frequency has a wave length in air of 4.678 inches.

Turning first to FIG. 3, front quarter-wave length plane 70 is located one quarter-wave length distance from central plane 46 towards the front of antenna 12. Likewise, a rear quarter-wave length plane 72 is located one quarter-wave length distance from central plane 46 towards the rear of the antenna. Arrow 74 extends right and left of plane 46 and represents an angular measurement scheme employing the angles defined as $\theta_1$ and $\theta 2$. $\theta_1$ and $\theta_2$ both have a value of zero degrees at the location of plane 46 and increase, right and left, to planes 70 and 72, respectively, where they both have values of 90°. As is apparent from the drawings, the antenna does not fully extend to planes 70 and 72. $\theta_1$ and $\theta_2$ both have values of approximately 87° at the location of front plane 44 and rear plane 54, respectively.

Lines of curvature defining the antenna body portions are defined by the collection of points of the radial distances from the axis of revolution of the antenna. For instance, the inside radius of the converter portion shown at **42*a*** is the collection of points defined by the formula:

$$R_{ic}(\theta_1)=A_1\cos\theta_1$$

where:, $0° \leqq \theta_1 \leqq 87°$

The outside of radius of converter portion is defined by the formula:

$$R_{oc}(\theta_1)=A_2\sec\theta_1$$

where:

$0° \leqq \theta_1 \leqq 87°$.

Obviously, if $\theta_1$ were allowed to reach 90°, the outside radius of the converter portion would reach infinity where front plane 44 and front quarter-wave plane 70 are coplanar. Among other difficulties, this situation would minimize the practicality of the device.

Likewise, the line of curvature defining the inside radius of the terminator portion **48*a* and the inside radius of the transformer portion 52*a*** are defined by the collection of points where $\theta_2$ ranges between 0° and 87° and:

$$R_{it}(\theta_2)=R_{itr}(\theta_2)=A_1\cos\theta_2.$$

The outside radius of the terminator portion **48*b*** is defined by:

$$R_{ot}(\theta_2)=A_2\cos\theta_2.$$

The outside radius of the transformer portion **52*b*** is defined by:

$$R_{otr}=A_3.$$

The points at which planes 70 and 72 intersect axis 22 are designated by the numbers 76 and 78, respectively, and are referred to as quarter-wave length points. Near-field radiation is that which appears to occur relative to an object which is extremely close, for example, within one-half to one-quarter wave length of the associated operating frequency. In this kind of setting, radiation wave fronts are strictly non-planar, and in particular, are extremely curvilinear. The instant antenna is designed to take advantage of the curvilinear wave front of nearfield radiation by conforming the active portions of the antenna to the radiation wave fronts. An antenna so constructed for an operating frequency of 2525 megahertz has a diameter, along plane 44, of approximately four inches and results in a gain of 8.6 dbi.

The dimensions of array 10 are set forth in terms of the wave length of the operating frequency in air $\lambda_a$.

Unlike the antenna body, the K factor is negligible for the array due to the extremely thin cylinder sidewalls, to be further described later herein. Therefore, $f_o = f_d$ for the parasitic array. Preferred dimensions for the parasitic array are provided, although a cumulative manufacturing tolerance of plus or minus five percent is acceptable.

Referring now to FIGS. 2 and 3, support 14, in the preferred embodiment, has an outside diameter of between 0.241 $\lambda_a$ and 0.267 $\lambda_a$, preferably 0.254 $\lambda_a$, an inside diameter of between 0.228 $\lambda_a$ and 0.252 $\lambda_a$, preferably 0.240 $\lambda_a$ and a side wall thickness of preferably 0.007 $\lambda_a$. Spacing of what is referred to as the first conductive element, element 26, on support 14 is between 0.219 $\lambda_a$ and 0.243 $\lambda_a$, preferably 0.231 $\lambda_a$ from plane 44, or, between 0.441 $\lambda_a$ and 0.488 $\lambda_a$, preferably 0.464 $\lambda_a$ from central plane 46. Successive elements on the array, away from the antenna, are spaced at between 0.303 $\lambda_a$ and 0.335 $\lambda_a$, preferably 0.319 $\lambda_a$ from the center of each element such as that depicted by line 26a. Element 40 is colocated with the other end of support 14. Each element should have a width along the support of between 0.0122 $\lambda_a$ and 0.0134 $\lambda_a$, preferably 0.0128 $\lambda_a$. The resistance of each element should be less than 0.5 ohms measured between two 180° opposed points on the circumference of the support, as depicted at 80, 82 in FIG. 2.

Provision of array 10 with eight elements spaced therealong provide an additional six dbi to the gain of the antenna, resulting in a total gain of 14.6 dbi for a four-inch diameter antenna. Overall length of the parasitic array is approximately 12 inches.

While the preferred embodiment of this parasitic array has been disclosed, it is appreciated that certain variations and modifications may be made without departing from the spirit of the invention.

It is claimed and desired to secure by Letters Patent:

1. A parasitic array for use on a transmission/reception antenna having a known operating frequency with a wavelength λ in air, comprising:

a hollow cylindrical dielectric tube of substantially circular uniform cross section, plural conductive film, ring-like parasitic elements disposed on the outer surface of said tube and extending circumferentially around said tube with said elements having a circumference of less than λ, wherein a first of said elements is spaced between 0.219λ and 0.243λ from one end of said tube and the successive elements are substantially uniformly spaced between 0.0303λ and 0.335λ apart along the length of said tube, and means for mounting one end of said tube on the antenna.

2. In combination with a nearfield/farfield transmission/reception antenna having a known operating frequency with a wavelength λ in air, a parasitic array comprising:

hollow, elongate cylindrical dielectric tube having an outside diameter of between 0.241 λ and 0.267 λ and an inside diameter of between 0.228° and 0.252°, and plural conductive film, ring-like elements spaced along the outer surface of said tube, said elements having a width of between 0.0122° and 0.0134°, wherein a first element is spaced between 0.219° and 0.243° from one end of said tube adjacent the antenna and successive elements are substantially uniformly spaced between 0.303° and 0.335° apart along the length of said tube.

3. The combination of claim 2, wherein said tube has eight elements spaced therealong.

4. The combination of:

a nearfield/farfield transmission/reception antenna having a transmission/reception axis, antenna portions having bodies of revolution symmetrical with respect to the axis, with inner and outer surfaces describing curvilinear lines defined by known equations, which is bounded by rear and front planes substantially normal to the axis, a generally circular, planar, ring-like conductive driven expanse occupying a position intermediate the rear and front planes symmetric and normal with respect to said axis, and having a known operating frequency with a wavelength λ in air and a parasitic array comprising:

a hollow, elongate cylindrical dielectric tube having a central axis, an outside diameter of between 0.241λ and 0.267λ and an inside diameter of between 0.228λ and 0.252λ, means for mounting one end of said tube on said antenna with said central axis coaxial with said transmission/reception axis, and plural conductive film, ring-like elements spaced along the outer surface of said tube normal to said central axis, said elements each having a width of between 0.0122λ and 0.0134λ, wherein a first element is spaced between 0.441λ and 0.488λ from said driven expanse and the successive elements are substantially uniformly spaced between 0.303λ and 0.335λ apart along the length of said tube, the planes of said elements being substantially parallel with the plane of said driven expanse.

5. The combination of claim 4 wherein said tube has eight elements spaced therealong, said first element is adjacent said one end of said tube and the eighth element is colocated with the other end of said tube.

6. The combination of claim 4, wherein said tube has closed ends.

7. The combination of claim 4, wherein said conductive elements are zinc arch bands which are formed on said tube, each of said bands having a resistance of less than 0.5 ohm measured at opposed points.

* * * * *